US005419168A

United States Patent [19]

Field

[11] Patent Number: 5,419,168

[45] **Date of Patent: * May 30, 1995**

[54] HIERARCHICAL CYLINDER LOCK AND KEY SYSTEM

[75] Inventor: Peter H. Field, Salem, Va.

[73] Assignee: Medeco Security Locks, Inc., Salem, Va.

[ * ] Notice: The portion of the term of this patent subsequent to Mar. 1, 2011 has been disclaimed.

[21] Appl. No.: 162,606

[22] Filed: Dec. 7, 1993

Related U.S. Application Data

[63] Continuation-in-part of Ser. No. 959,018, Oct. 24, 1991, Pat. No. 5,289,709.

[51] Int. Cl.[6] ..... E05B 27/04

[52] U.S. Cl. ..... 70/494; 70/378; 70/409; 70/495

[58] Field of Search ..... 70/378, 392, 403–406, 70/409, 419, 421, 491, 493–496, 340

[56] References Cited

U.S. PATENT DOCUMENTS

| | | | |
|---|---|---|---|
| 396,628 | 1/1889 | Hoevenbergh . | |
| 420,174 | 1/1890 | Taylor . | |
| 564,803 | 7/1896 | Stadtmuller . | |
| 567,305 | 9/1896 | Donovan . | |
| 567,624 | 9/1896 | Taylor . | |
| 1,439,382 | 12/1922 | Segal . | |
| 2,408,283 | 9/1946 | Wollin | 70/419 |
| 3,099,151 | 7/1963 | Schlage . | |
| 3,348,392 | 10/1967 | Schreiber | 70/340 |
| 3,349,587 | 10/1967 | Keller . | |
| 3,499,302 | 3/1970 | Spain et al. . | |
| 3,722,240 | 3/1973 | Spain et al. | 70/494 |
| 3,731,507 | 5/1973 | Wolter | 70/358 |
| 3,738,136 | 6/1973 | Falk | 70/340 X |
| 3,974,670 | 8/1976 | Wolter | 70/421 X |
| 4,098,103 | 7/1978 | Roskevicius | 70/494 |
| 4,098,104 | 7/1978 | Wolter | 70/406 |
| 4,103,526 | 8/1978 | Surko, Jr. | 70/494 |
| 4,107,966 | 8/1978 | Schlage | 70/375 X |
| 4,235,086 | 11/1980 | Genakis | 70/494 |
| 4,289,002 | 9/1981 | Gretler | 70/358 |
| 4,325,241 | 4/1982 | Keller | 70/358 |
| 4,424,692 | 1/1984 | Rousseau | 70/403 X |
| 4,635,455 | 1/1987 | Oliver | 70/419 X |
| 4,756,177 | 7/1988 | Widén | 70/378 X |
| 4,760,722 | 8/1988 | Fann et al. | 70/358 |
| 5,289,709 | 3/1994 | Field | 70/494 |

FOREIGN PATENT DOCUMENTS

| | | | |
|---|---|---|---|
| 1533953 | 6/1968 | France | 70/421 |
| 2420007 | 10/1979 | France | 70/493 |

*Primary Examiner*—Lloyd A. Gall
*Attorney, Agent, or Firm*—Rothwell, Figg, Ernst & Kurz

[57] ABSTRACT

A hierarchical lock and key system includes a plurality of locks and keys wherein each key is provided with at least one unique bitting surface that engages a complementarily shaped tumbler pin tip to cause the tumbler pin to rotate and be positioned at a predetermined location. In one system, one key is provided with bittings to rotate the tumbler pins in a lock that is able to determine the rotational position of the tumbler pins. The one key may also operate a lock which does not determine the rotational position of the tumbler pins by positioning a tumbler pin at its proper elevation in the cylinder. Another key which has at least one different bitting from the one key will operate the latter lock (in which the tumblers do not have to be rotated). However, the other key will not operate the former lock because the bitting does not, properly rotate the tumbler pin to its unlocking location. The complementarily shaped contacting surfaces of the tumbler pin and key are generally sloped from one edge to an opposite edge in tapered form and may be flat, concave, convex, or a combination thereof.

6 Claims, 7 Drawing Sheets

HIERARCHICAL CYLINDER LOCK AND KEY SYSTEM

CROSS-REFERENCE TO RELATED APPLICATIONS

This application is a continuation-in-part of application Ser. No. 07/959,018 filed Oct. 24, 1991, and now U.S. Pat. No. 5,289,709, granted Mar. 1, 1994 on an invention of Peter H. Field, assigned to Medeco Security Locks, Inc.

BACKGROUND OF THE INVENTION

1. Field of the Invention

This invention relates generally to improvements in cylinder lock and key systems and, more particularly, to hierarchical lock and key systems.

2. Description of the Prior Art

Yale type cylinder locks are well known and have been in continuous use since 1865. Typically, in such locks key differs are developed by adjusting incrementally the lengths of the bottom most pin tumblers and the corresponding bitting depths on the key. In addition, several techniques have been developed to arrange lock cylinders and their associated keys in hierarchical systems. For example, U.S. Pat. No. 369,628 to Van Hoevenbergh illustrates segmented pin tumblers disposed in one or more columns which allow several keys which are bitted differently from each other to operate a single cylinder. U.S. Pat. No. 420,174 to Taylor discloses non-rotatable pins with contact surfaces of different heights which permit different keys to operate the same cylinder. U.S. Pat. No. 564,803 to Stadtmuller discloses tumbler pins having dual vertical key contact surfaces operable by different keys. U.S. Pat. No. 567,305 to Donovan provides master keying capability through variations in the shape of the key profile and the corresponding keyway in the cylinder. U.S. Pat. No. 567,624 to Taylor provides master keying capability by using plate tumblers for changing the tumbler-key contact area which allows different keys to operate the same cylinder. In addition, U.S. Pat. No. 3,349,587 to Keller discloses a method of positional masterkeying.

Despite the many masterkeyed or hierarchical lock systems known in the art, there remains a need for new and improved lock cylinders that can be operated by more than one key. In large buildings and institutions, for example, cylinders and keys are often arranged in masterkeyed systems for the convenience of management personnel.

Interchangeable core cylinders are operable by a control key, and this permits a quick exchange of the core containing the tumblers for a core operated by a different key. See also the prior art currently classified in class 70, subclass 369 in the U.S. Patent and Trademark Office.

Cylinders also have been constructed which cooperate with different keys to allow for selective rotation of the barrels. See, for example, U.S. Pat. No. 4,107,966 to Schlage which discloses a cylinder that is partially operated by one key to retract a latchbolt, and is fully operated by another key to retract the latchbolt and a deadbolt.

Further, some lock cylinders are operable by a first key, but are adjusted when operated by a second key so as to render the cylinders operable only by the second key. See U.S. Pat. No. 3,099,151 to Schlage and the prior art currently classified in class 70, subclass 383 in the U.S. Patent and Trademark Office. The above-mentioned patents are only some examples of cylinders that are operable with different keys.

The positioning of tumbler pins by unique keys has been the subject of continuous improvement in the lock art. Patents issued for the great majority of lock cylinders now on the market have expired. Their keys can be copied on conventional machines of the type described in U.S. Pat. No. 1,439,382 to Segal. The keyblanks required are widely distributed beyond the control of the lock manufacturer. The development of skew cut bittings by Spain et al., as described in U.S. Pat. No. 3,499,302, provided additional security to the key owner because conventional rotary machines could not duplicate these angled cuts. However, as there have been machines developed to duplicate skew cut bittings, their security is reduced. Uniquely shaped bittings and controlled distribution of proprietary keyblanks reduces the odds that keys in the possession of dishonest employees can be copied at hardware stores and the like.

Notwithstanding improvements in the well worked lock arts, there remains a need for lock cylinders which can be operated by different keys and arranged in hierarchical systems. Such lock mechanisms should also resist contemporary lockpicking techniques, including impressioning methods to obtain false keys. It is also desirable that the dimensions of the lock not exceed conventional cylinder size. It is equally important that the components and the lock assembly can be economically mass produced.

SUMMARY OF THE INVENTION

The present invention provides unique lock cylinder mechanisms that can be operated by different keys. The cylinders and keys according to the present invention can be arranged in hierarchical systems to perform special functions and provide masterkeying capability. The cylinders provide an extraordinary large number of key differs through the use of tumbler pins that can be positioned rotationally, elevationally, axially, or combinations thereof. The locking tumbler pins are highly resistant to picking, are dimensionally compatible with industry standards, and are suitable for mass production.

These objectives are accomplished by a lock cylinder, or group of cylinders, each cylinder having at least one rotatable tumbler pin with a specially shaped tip. The specially shaped offset tumbler pin tip is tapered such that it slopes from adjacent one side edge thereof to adjacent an opposite side edge, and such taper can be flat, rounded, (e.g., convex or concave), partially flat, or partially rounded. The tapered tumbler pin tip is adapted to engage with a key having at least one complementarily shaped bitting surface, i.e., complementary to the tapered, or sloping surface of the tumbler pin tip, such that the tumbler pin will seek to accommodate the sloping surface of the key bitting to align the tumbler pin at its proper position.

The complementary sloping surfaces formed on the tumbler pin and the key bitting are preferably of the type disclosed in my co-pending application Ser. No. 07/959,018 filed Oct. 24, 1991, now U.S. Pat. No. 5,289,709, the subject matter of which application is expressly incorporated herein by reference.

Cylinders which read the rotational positioning of the tumbler pins require that the tumbler pins be individually rotated to a predetermined position to permit rotation of the barrel. Such cylinders can be operated only by a key which is bitted so as to rotate the tumbler to the predetermined position. On the other hand, lock cylinders which do not have a mechanism which reads or differentiates between rotational positions of the pins can be operated by any key which is bitted so as to position the pins at their proper elevation, regardless of the rotational position to which the key moves the pins.

Accordingly, in one hierarchical system of the present invention, a key which is bitted to rotate a tumbler pin to its proper position can operate both types of lock cylinders, i.e., those which read or do not read the rotational position of the tumbler pins. This is because in addition to rotating the tumbler pins, the key will position the tumbler pin at its proper elevation in either cylinder. In the cylinder that does not read tumbler pin rotation, this is all that is required for operation. However, keys that are not bitted to rotate a tumbler pin to a particular position (e.g., so as to receive a leg of a sidebar) will operate one but not both cylinder types. Specifically, such keys will operate a cylinder that does not read rotation of the tumbler pins by elevating the pins to their correct operating position at the shear line, but will not operate a cylinder which requires rotational positioning of one or more pins because there is no complimentary bitting surface on the key to also rotate the pins to their proper position.

One hierarchical system of the present invention includes lock cylinders having at least one rotatable tumbler pin and a key with a unique complimentary bitting surface which mates with the tumbler pin tip as described above. The lock cylinders can be manufactured to use any of various prior art mechanisms for reading the rotational position of the tumbler pins, e.g., a sidebar, "fence," or a mating tongue and groove structure between the driver and tumbler pin as shown in U.S. Pat. No. 4,103,526 to Surko, Jr.

The present invention also includes a partially manufactured key in the form of a key blank with at least one bitting surface pre-manufactured therein. The bitting surface is shaped according to the present invention for engaging a complementarily shaped tumbler pin tip.

DETAILED DESCRIPTION OF THE PREFERRED EMBODIMENTS

Figures 1A, 1B, 1C, 1D, 1E, 1F, 1G:
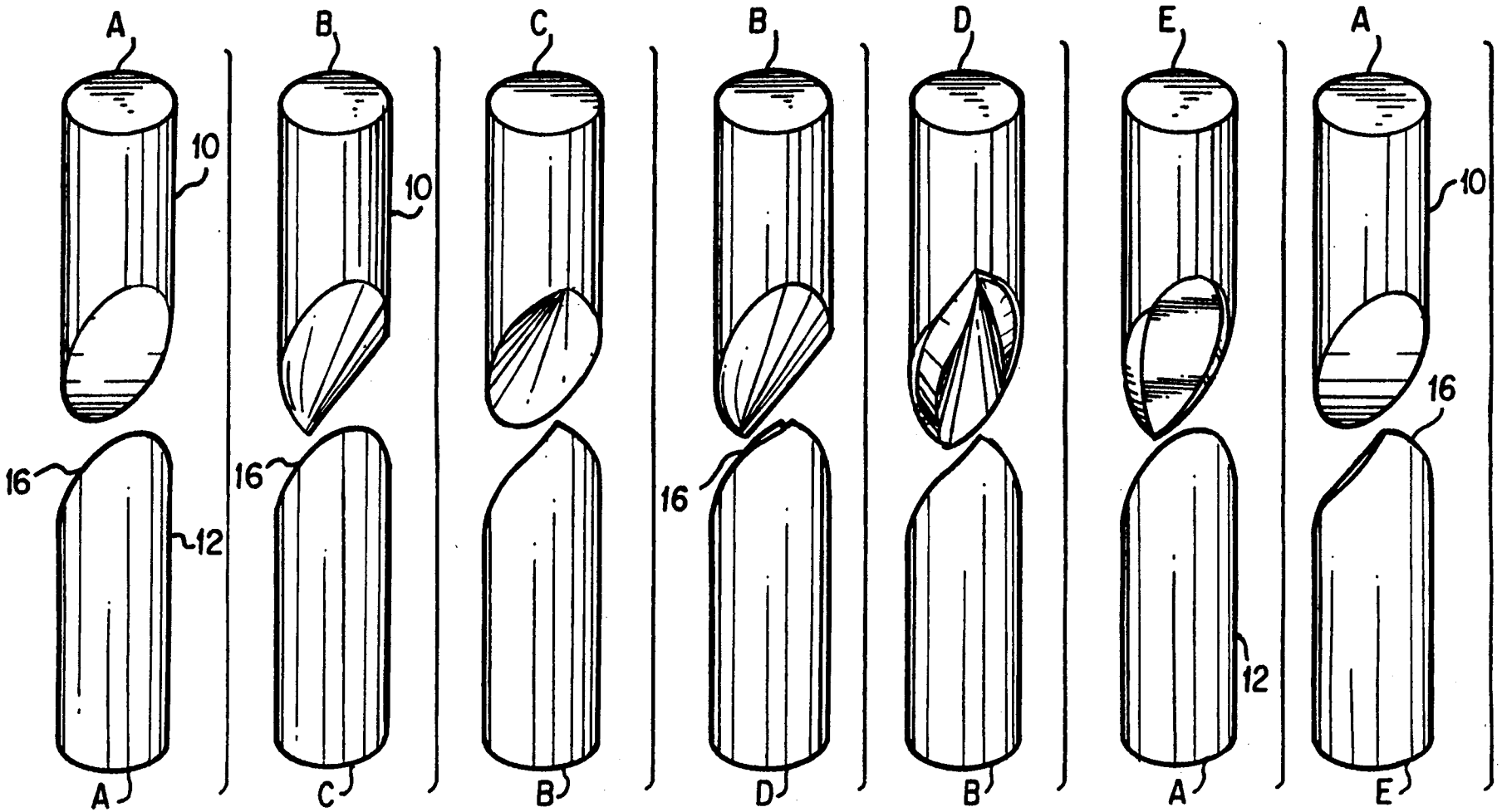
FIGS. 1*a*–1*g* are side elevational views illustrating the surfaces of a tumbler pin tip and complementary configured key bitting surfaces which constitute part of this invention.
Figure 2A:
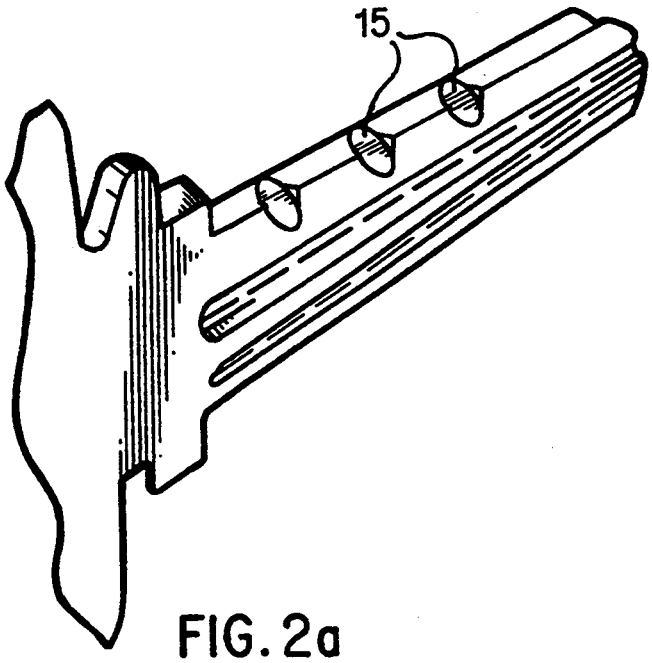
FIG. 2*a*–2*e* are perspective views of several keys having a complementary configured portion formed on their bitting surfaces.
Figure 2B:
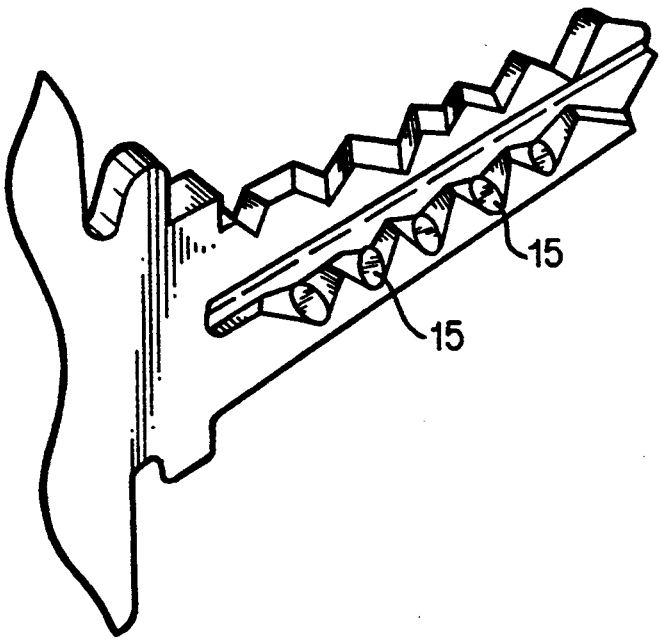

With reference to FIGS. 1*a* through 1*g*, each set of elements represents a rotatable tumbler pin 10 and a corresponding key bitting surface configuration 16. The tumbler pin 10 would be retained in a tumbler pin bore (not shown) as is well known in the art. The key configuration 12 is only a representative portion of the key bitting surface at the tumbler pin contact area for illustrative purposes, the actual key would be along the lines as shown in FIGS. 2*a*–2*e*.

The tumbler pin body 10 is generally cylindrical and operates in a bore and typically would be biased towards the key by spring, gravity, magnetic, or other means as is known in the art. The complementarily shaped tumbler pin tips and key bitting surfaces shown in FIGS. 1*a*–1*g* are fully described in the aforementioned co-pending parent application incorporated herein by reference and thus will not be discussed in detail.

FIGS. 2*a*–2*e* are illustrations of keys for locks utilizing the unique tumbler pins of the present invention, which keys may be manufactured from key blanks to include a key bow and blade. One or more bitting areas 15 are positioned along the bitting surface of the key blade and are shaped, cut, formed, or bitted according to the configurations in the bottom row of FIGS. 1*a*–1*g* to mate with the tumbler pin tips in the top row of FIGS. 1*a*–1*g* to precisely position the tumbler pins. The keys shown in FIGS. 2*a*–2*e* are also described in detail in the co-pending parent application now U.S. Pat. No. 5,289,709. The present invention includes a partially manufactured key in the form of a key blank having at least one bitting area or surface therein corresponding to the bitting areas 15 shown in FIGS. 2A–2E.

Figure 3:
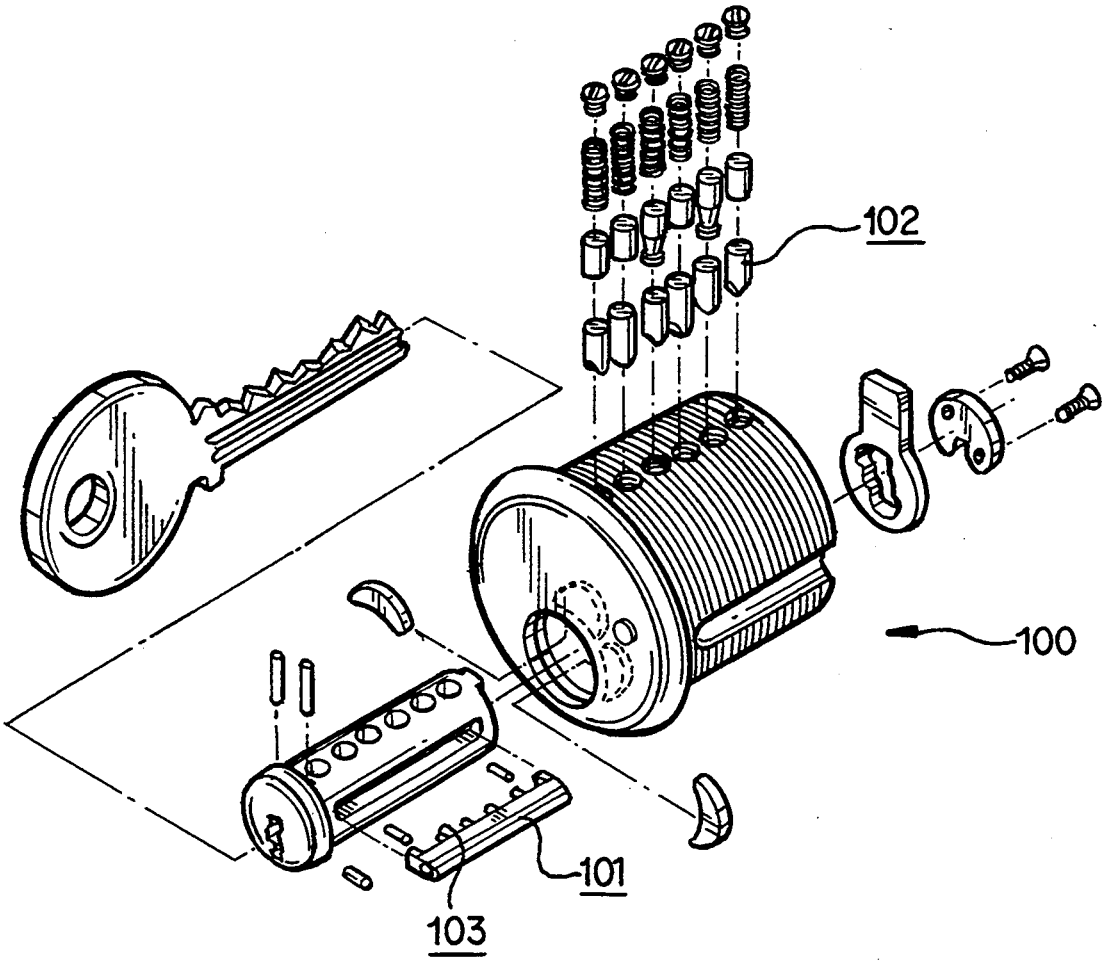
FIG. 3 PRIOR ART
FIG. 3 is a perspective view of a Medeco ® type cylinder lock.
Figure 2C:
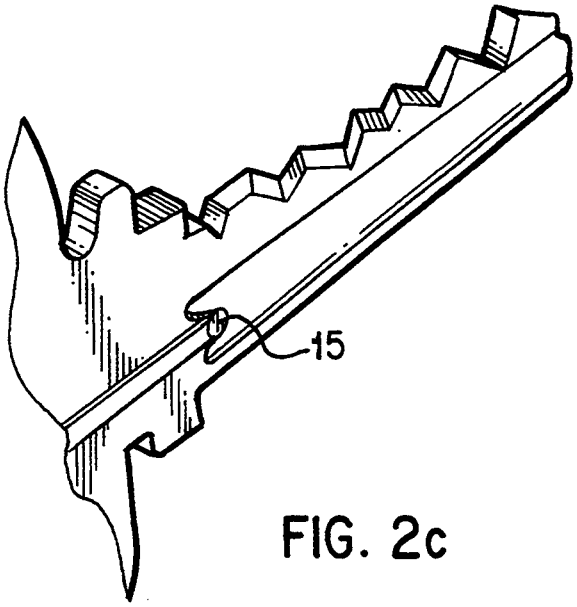
Figure 2D:
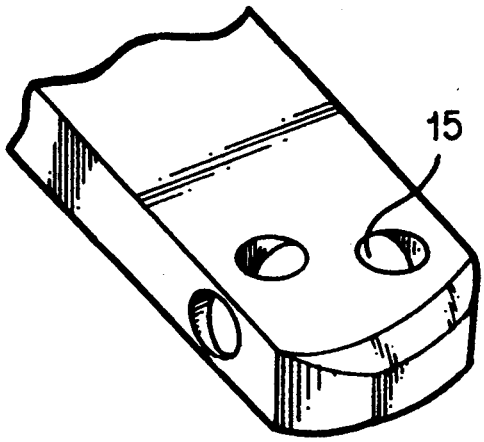
Figure 2E:
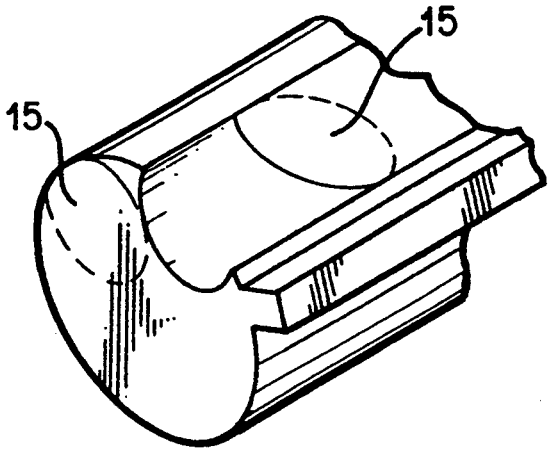

While it will be recognized, of course, that the hierarchical lock and key system of the present invention is not limited to any one particular type of lock, an example of a lock suitable for use in the present invention is shown in FIG. 3. The lock 100 is a high security cylinder-type lock, manufactured by Medeco Security Locks, Inc., and utilizes rotatably and elevationally positionable tumbler pins as described in U.S. Pat. No. 3,499,302 to Spain et al, which teaches a fence or side bar 101 that requires proper rotation and location of tumbler pins 102 for alignment of tumbler slots with side bar legs 103 as shown in FIG. 3.

Figure 4:
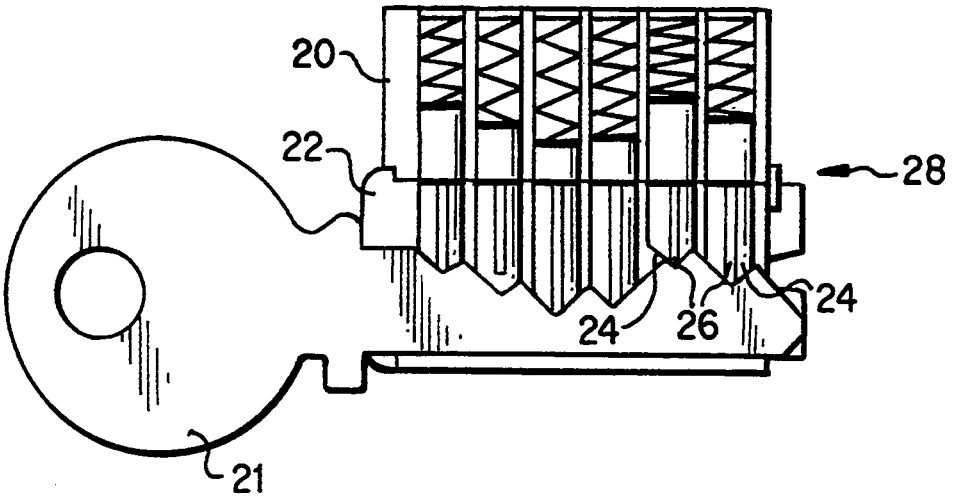
FIG. 4 PRIOR ART
FIG. 4 is a side sectional view of a Medeco ® type cylinder with a key inserted therein. The Medeco ® lock and key of FIGS. 3 and 4 are prior art.

FIG. 4 is a side sectional view of a Medeco ® lock 20 with the correct key 21 inserted in the barrel 22. The top edges of the tumbler pins 24 are elevated to the shear line 28, coincidental with the outer diameter of the barrel 22, and the sidebar slots or gates 26 in tumbler pins 24 are rotated into alignment with the sidebar legs 103 (see FIG. 3) by the skew cut bittings on the key 21.

Figure 5:
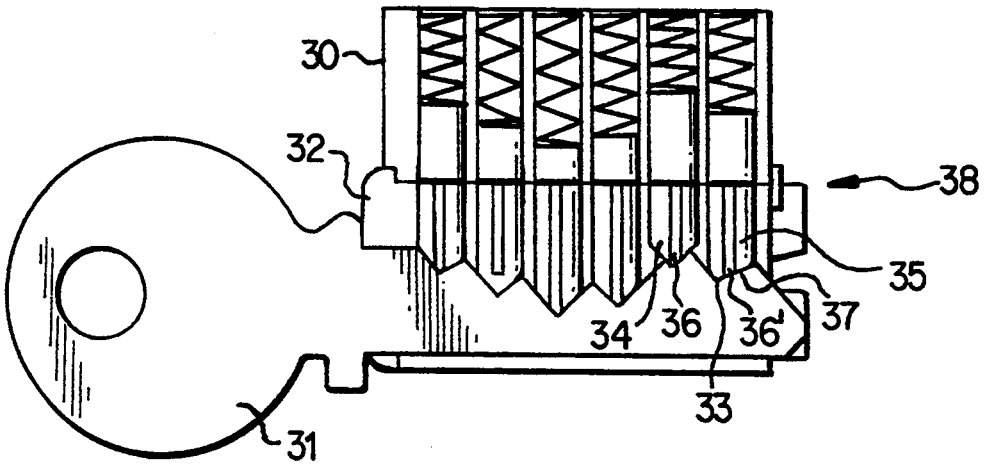
FIG. 5 is a side sectional view of a Medeco ® type cylinder including a tumbler pin constructed according to the present invention.

FIG. 5 is a side sectional view of a Medeco ® lock cylinder 30 including tumbler pins 34 and 35. The tip 37 of tumbler pin 35 is modified according to the present invention so as to slope from one edge thereof to the opposite edge as taught in U.S. Pat. No. 5,289,709. A key 31 has a complementary bitting surface 33 modified in accordance with the present invention so as to mate with tumbler tip 37 to rotate the tumbler pin 35 to its proper position. Tumbler pins 34, 35 are provided with sidebar slots 36, 36', respectively. When inserted into cylinder barrel 32, key 31 properly elevates the tumbler pins 34 and 35 to the shear line 38 and rotates the tumbler pins so that the sidebar slots 36 and 36' are in alignment with the sidebar legs 103.

Figure 6A:
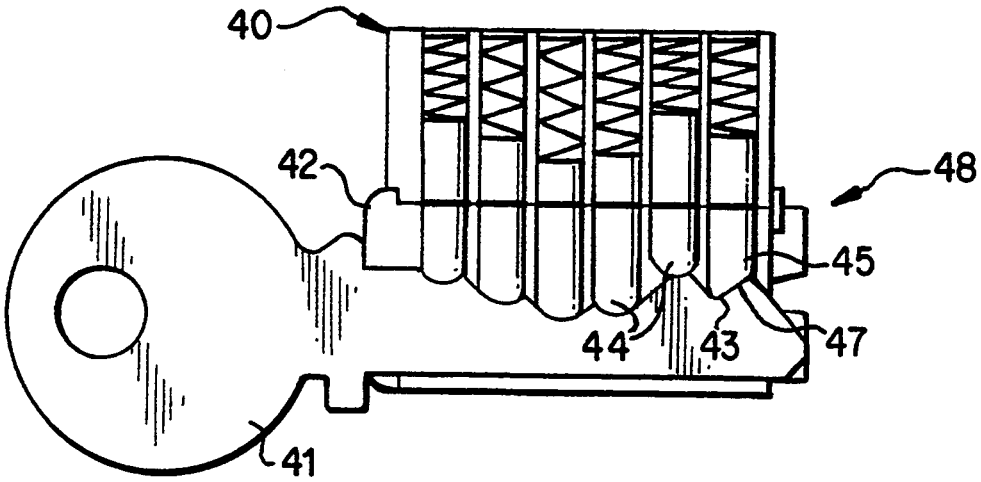
FIGS. 6*a* and 6*b* are side sectional views of conventional cylinders including tumbler pins constructed according to the present invention. The Medeco ® lock and key of FIGS. 3 and 4 are prior art.

FIG. 6a is a side sectional view of a lock cylinder 40 including tumbler pins 44, 45 with the tip 47 of pin 45 being shaped in accordance with the present invention. Key 41 has bitting surface 43 which is shaped complementarily to tip 47 of pin 45. When the correct key 41 is inserted into the cylinder barrel 42, the tumbler pins 44 and 45 are elevated to the correct position at tile shear line 48. Because most common lock cylinders are not manufactured with sidebars, the symmetrical conical tipped tumbler pins 44 do not need or have sidebar slots (and, therefore, are not rotated to any particular position by the key).

However, the tip 47 of tumbler pin 45 is provided with an offset sloped or slanted shape according to the present invention. Therefore, tumbler pin 45 must rotate in its bore to fully seat on the complementarily shaped bitting surface 43 of the key 41, which full engagement between the pin tip and key bitting is necessary to position the tumbler at the shear line 48 as described in the aforementioned parent application.

Figure 6B:
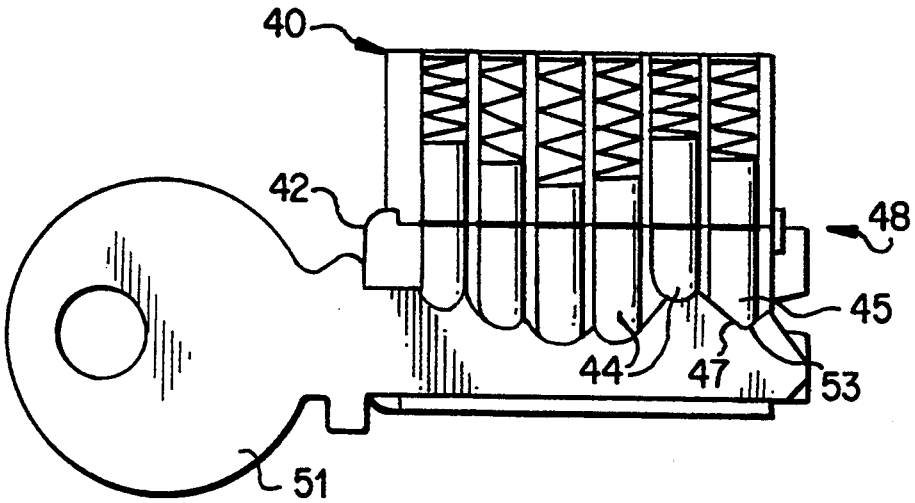

FIG. 6b is a side sectional view of the same lock cylinder 40 shown in FIG. 6a with the tip 47 of the same tumbler pin 45 modified according to the present invention. A key 51, which is different than key 41, has a corresponding bitting surface 53 which is bitted to the same depth as surface 43 of key 41. The bitting surface 53 of key 51 varies from the bitting surface 43 of key 41 only with respect to the rotational position thereof relative the longitudinal axis of the tumbler pin 45, i.e., as to the rotational position to which the bitting moves tumbler pin When the key 51 is inserted into the barrel 42, it elevates the tumbler pins 44 and 45 to their proper position at the shear line 48 (as does key 41). As stated above, tumbler pin 45 has a slanted tip 47 and must rotate in its bore to fully seat on the complementarily shaped bitting surface 53 of key 51 in order to be correctly elevated. As also stated above, most common lock cylinders are not manufactured with sidebars so the tumbler pins 44, 45 in cylinder 40 do not have sidebar slots. Therefore, tumbler pins 44, 45 do not have to be rotated to any particular position to operate the cylinder. This allows cylinder 40 to be operated by key 41 or 51 despite the fact that each key may rotate tumbler pin 45 to a different position.

The key 31 shown in FIG. 5 is bitted to the same depth as keys 41 and 51 in FIGS. 6a and 6b and, in addition, is provided with the shaped bitting surface 33 corresponding to the complementarily shaped tip 47 of tumbler pin 45. As such, key 31 will also operate lock cylinder 40 (of FIGS. 6A and 6B) by positioning the tumbler pins 44 and 45 at their correct elevation.

Conversely, keys 41 and 51 are not configured with the skew bittings necessary to rotate pin 34 of cylinder 30 in FIG. 5, and thus cannot position pin 34 so as to align the sidebar slots 36 therein with the legs of the sidebar in the Medeco® lock cylinder. Consequently, keys 41 and 51 will not operate the lock cylinder 30 shown in FIG. 5.

Figure 7:
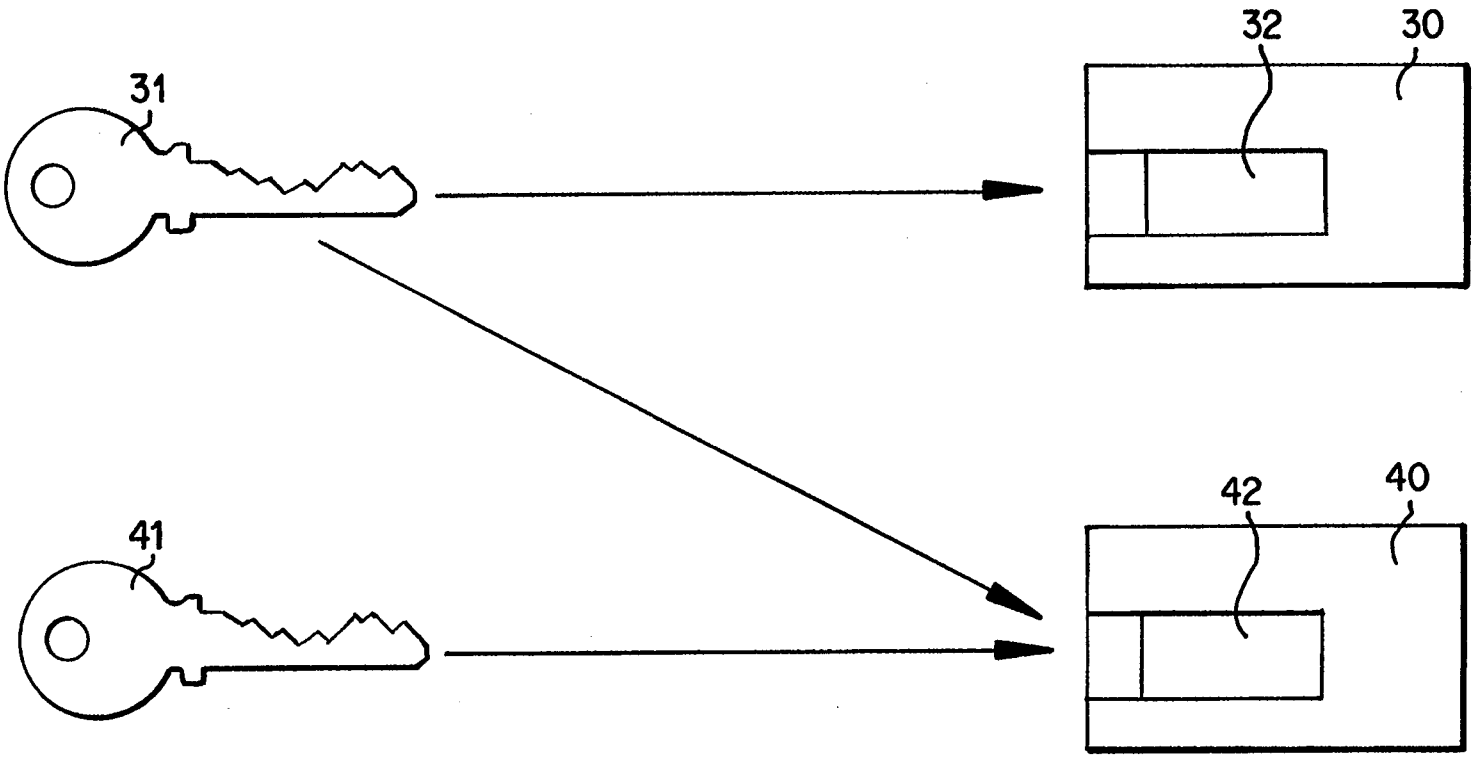
FIG. 7. is a schematic diagram of pair of lock cylinders and keys which constitute a hierarchical system.

FIG. 7 is a schematic diagram representing a hierarchical system of the locks and keys illustrated in FIGS. 5 and 6a and discussed above. As indicated by the arrows in FIG. 7, key 31 will operate lock 30 and lock 40. However, key 41 will operate lock 40, but not lock 30.

It will be appreciated by those skilled in the art that the exemplary hierarchical system of locks and keys described above and shown schematically in FIG. 7 is but one very simplified application of the present invention. Further, those skilled in the art will readily recognize that the present invention can be applied to hierarchical lock and key systems of many different sizes and which include various types of locks, keys, and combinations thereof. Moreover, it is within the scope of the present invention to utilize conventional techniques for masterkeying, key differing, key changing and core removal combined with the novel complementarily shaped tumbler pin tips and key bitting surfaces.

Although the present invention has been described with reference to particular embodiments, it is to be understood that the embodiments are merely illustrative of the application of the principles of the invention. Numerous configurations may be made therewith and other arrangements may be devised without departing from the spirit and scope of the invention.

I claim:

1. A method of operating a hierarchical system of locks and keys wherein there are at least two different locks and at least two different keys, one of the keys being a first key which operates less than the total number of locks and another of the keys being a second key which operates more locks than the first key, the locks being cylinder locks having tumbler pins which, when operated with the proper keys, are positioned to permit operation of the lock, the method comprising steps of:

providing all of the locks with at least one tumbler pin with a tip surface shaped to slope from adjacent one side surface of the tumbler pin to adjacent an opposite side surface of the tumbler pin to furnish a single slanting contact surface for cooperating with a complementarily bitted surface on a key;

providing all of the keys with at least one bitting surface shaped substantially complementarily to the single slanting contact surface of the tumbler pin of each lock for cooperating with the tumbler pin contact surface and causing the tumbler pin to be rotated and positioned at a proper unlocking location so as to clear a shear line of a lock;

forming at least one bitting surface of the first key differently than at least one bitting surface of the second key so that the keys cause said at least one tumbler pin having a single slanting contact surface of each lock to be moved to different rotational positions;

providing at least one of the locks with a means for differentiating between the different bitting surfaces on the keys so that the one lock can be operated only if said at least one tumbler pin having a single slanting contact surface is positioned so as to clear the shear line of the lock and is moved, to a proper rotational position, whereby the one lock can be operated by the second key but not by the first key; and inserting one of the keys into the one lock to rotate the at least one tumbler pin having a single slanting contact surface so as to operate the one lock into which the key is inserted.

2. In a hierarchical system of locks and keys including at least a first lock and a second lock which are different from each other, and at least a first key and a second key which are different from each other, the first key operating less than the total number of locks and the second key operating more locks than the first key, the locks being cylinder-type locks having tumbler pins which, when operated with the proper keys, are positioned to permit operation of the cylinder, with improvements in the system comprising:

said first and second locks each having at least one tumbler pin with an offset tip surface shaped to slope from adjacent one side surface of the tumbler pin to adjacent an opposite side surface of the tumbler pin to provide a single slanting contact surface for cooperating with a complementarily bitted surface formed on the first and second keys;

the first and second keys each having at least one bitting surface shaped substantially complementarily to the shaped-tip of the tumbler pin of said first and second locks, such that the bitting surface of each key cooperates with the single slanting contact surface of the tumbler pin of each lock to cause the tumbler pin to rotate about its axis and be positioned to a proper unlocking elevation relative a shear line of the first and second locks;

the first lock being operable by either the first key or the second key with the bitting surface of the key rotating the tumbler pin with a single slanting contact surface to the proper unlocking position at which the tumbler pin is elevated to clear a shear line of the first lock such that the cylinder thereof may be operated;

the second lock being operable by one of the first and second keys but not both keys, the second lock having means for determining whether at least one additional tumbler pin therein is properly positioned rotationally so as to permit the second lock to be operated, wherein the bitting surface of the key which operates the second lock rotates said at least one additional tumbler pin therein to a proper unlocking position at which said at least one additional tumbler pin is elevated to clear a shear line of the second lock and is positioned rotationally so as to permit operation of the cylinder of the second lock, and the key which does not operate the second lock does not rotate said at least one additional tumbler pin therein to the proper rotational position.

3. A hierarchical system according to claim 2, wherein the bitting surface of at least one key and the complementarily shaped surface of at least one tumbler pin tip are substantially flat sloping surfaces throughout their contact area.

4. A hierarchical system according to claim 2, wherein one of the cooperating key bitting surface and complementary tumbler pin tip surface is a curved convex surface, while the other of the surfaces is a curved concave surface.

5. A hierarchical system according to claim 2, wherein one of the cooperating key bitting surface and complementary tumbler pin tip surface is a curved convex surface, while the other is partially concave in the central portion of the surface and is surrounded on both sides by a shaped side portion.

6. A hierarchical system according to claim 2, wherein one of the keys includes a blade of a generally rectangular shape with the shaped bitting surface formed in a top edge or a side edge of the blade.

* * * * *

UNITED STATES PATENT AND TRADEMARK OFFICE

CERTIFICATE OF CORRECTION

PATENT NO. : 5,419,168
DATED : May 30, 1995
INVENTOR(S) : Peter H. Field

It is certified that error appears in the above-indentified patent and that said Letters Patent is hereby corrected as shown below:

Title page, item [57], col. 2, in the Abstract: line 16, delete the comma;
Column 4, line 46, "al," should be -- al.
Column 5, line 9, "tile" should be -- the --;
Column 5, line 33, after "pin" insert -- 45. --;
Column 7, line 12 (claim 2), "shaped-tip" should be -- shaped tip --.

Signed and Sealed this

Twenty-fourth Day of October, 1995

*Attest:*

Bruce Lehman

BRUCE LEHMAN

*Attesting Officer*

*Commissioner of Patents and Trademarks*